US008829463B2

(12) United States Patent
Senko et al.

(10) Patent No.: US 8,829,463 B2
(45) Date of Patent: Sep. 9, 2014

(54) ION CARPET FOR MASS SPECTROMETRY HAVING PROGRESSIVE ELECTRODES

(71) Applicants: Michael W. Senko, Sunnyvale, CA (US); Eloy R. Wouters, San Jose, CA (US)

(72) Inventors: Michael W. Senko, Sunnyvale, CA (US); Eloy R. Wouters, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 13/956,907

(22) Filed: Aug. 1, 2013

(65) Prior Publication Data

US 2014/0034828 A1 Feb. 6, 2014

Related U.S. Application Data

(60) Provisional application No. 61/679,501, filed on Aug. 3, 2012.

(51) Int. Cl.
*G21K 5/04* (2006.01)

(52) U.S. Cl.
USPC ..... 250/396 R; 250/396 ML; 250/397; 250/281; 250/282

(58) Field of Classification Search
USPC ..... 250/396 R, 397, 396 ML
See application file for complete search history.

(56) References Cited

U.S. PATENT DOCUMENTS

| | | | | |
|---|---|---|---|---|
| 3,081,020 | A | 3/1963 | Rostas | |
| 5,248,883 | A | 9/1993 | Brewer et al. | |
| 5,302,827 | A | 4/1994 | Foley | |
| 5,572,035 | A | 11/1996 | Franzen | |
| 6,107,628 | A | 8/2000 | Smith et al. | |
| 6,180,942 | B1 | 1/2001 | Tracy et al. | |
| 6,583,408 | B2 | 6/2003 | Smith et al. | |
| 6,683,301 | B2 | 1/2004 | Whitehouse et al. | |
| 8,299,443 | B1 * | 10/2012 | Shvartsburg et al. | 250/396 R |
| 2010/0148062 | A1 | 6/2010 | Wollnik et al. | |
| 2013/0120894 | A1 | 5/2013 | van Amerom et al. | |
| 2013/0175440 | A1 | 7/2013 | Perelman et al. | |

OTHER PUBLICATIONS

Takamine et al., "Space-charge effects in the catcher gas cell of a rf ion guide," Review of Scientific Instruments 76, 103503 (2005), pp. 1-6.

S. Schwarz, "RF Ion Carpets, The electric field, the effective potential, operational parameters and an analysis of stability," International Journal of Mass Spectrometry 299 (2011), pp. 71-77.

* cited by examiner

*Primary Examiner* — Nicole Ippolito
*Assistant Examiner* — Hanway Chang
(74) *Attorney, Agent, or Firm* — Thomas F. Cooney

(57) ABSTRACT

An ion transport apparatus for a mass- or ion-mobility-spectrometer comprises: (a) a plurality of strip electrodes in a series on a flat substrate; (b) an ion outlet aperture in the substrate disposed adjacent to a first one of the plurality of strip electrodes; (c) a cage electrode at least partially enclosing the plurality of strip electrodes and the ion outlet aperture; (d) a radio frequency (RF) voltage generator operable to supply an RF phase difference between each pair of adjacent electrodes; and (e) at least one DC voltage source operable to supply first and second DC voltages to the cage electrode and an extraction electrode and to supply respective DC bias voltages to each of the plurality of electrodes, wherein electrode strip widths of a series of the plurality of electrodes progressively increase away from the first one of the plurality of electrodes.

18 Claims, 7 Drawing Sheets

ION CARPET FOR MASS SPECTROMETRY HAVING PROGRESSIVE ELECTRODES

CROSS-REFERENCE TO RELATED APPLICATION

This application claims the priority benefit under 35 U.S.C. §119(e) of U.S. Provisional Application for Patent Ser. No. 61/679,501 entitled, "Ion Carpet for Mass Spectrometry Having Progressive Electrodes" filed Aug. 3, 2012, said provisional application incorporated by reference herein in its entirety for all purposes.

FIELD OF THE INVENTION

The present invention relates generally to ion optics for mass spectrometers, and more particularly to a device for confining and focusing ions at atmospheric pressure and at moderate vacuum conditions and to ion source apparatuses using the device.

BACKGROUND OF THE INVENTION

A fundamental challenge faced by designers of mass spectrometers is the efficient transport of ions from the ion source to the mass analyzer, particularly through atmospheric or low vacuum regions where ion motion is substantially influenced by interaction with background gas molecules. While electrostatic optics are commonly employed in these regions of commercially available mass spectrometer instruments for ion focusing, it is known that the effectiveness of such devices is limited due to the large numbers of collisions experienced by the ions. Consequently, ion transport losses tend to be high, which has a significant adverse impact on the instrument's overall sensitivity.

FIG. 1 is a simplified schematic diagram of a known mass spectrometer system 10. Referring to FIG. 1, an API source 12 housed in an ionization chamber 14 is connected to receive a liquid sample from an associated apparatus such as for instance a liquid chromatograph or syringe pump through a capillary 7. The API source 12 optionally is an electrospray ionization (ESI) source, a heated electrospray ionization (H-ESI) source, an atmospheric pressure chemical ionization (APCI) source, an atmospheric pressure matrix assisted laser desorption (MALDI) source, a photoionization source, or a source employing any other ionization technique that operates at pressures substantially above the operating pressure of mass analyzer 28 (e.g., from about 1 torr to about 2000 torr). The API source 12 forms charged particles 9 (either ions or charged droplets that may be desolvated so as to release ions) representative of the sample, which charged particles are subsequently transported from the API source 12 to the mass analyzer 28 in high-vacuum chamber 26 through at least one intermediate-vacuum chamber 18. In particular, the droplets or ions are entrained in a background gas and transported from the API source 12 through an ion transfer tube 16 that passes through a first partition element or wall 11 into an intermediate-vacuum chamber 18 which is maintained at a lower pressure than the pressure of the ionization chamber 14 but at a higher pressure than the pressure of the high-vacuum chamber 26. The ion transfer tube 16 may be physically coupled to a heating element or block 23 that provides heat to the gas and entrained particles in the ion transfer tube so as to aid in desolvation of charged droplets so as to thereby release free ions.

Due to the differences in pressure between the ionization chamber 14 and the intermediate-vacuum chamber 18 (FIG. 1), gases and entrained ions are caused to flow through ion transfer tube 16 into the intermediate-vacuum chamber 18. A plate or second partition element or wall 15 separates the intermediate-vacuum chamber 18 from either the high-vacuum chamber 26 or possibly a second intermediate-pressure region 25, which is maintained at a pressure that is lower than that of chamber 18 but higher than that of high-vacuum chamber 26. Vacuum port 13 is used for evacuation of the intermediate-vacuum chamber 18 by means of a mechanical pump or equivalent. Under typical operating conditions, the pressure within chamber 18 will be in the range of 1-50 Torr.

The analyte ions exit the outlet end of ion transfer tube 16 as a free jet expansion and travel through an ion channel 41 defined within the interior of ion transport device 40. As discussed in further detail in U.S. Pat. No. 7,781,728, the entire disclosure of which is incorporated herein by reference, radial confinement and focusing of ions within ion channel 41 are achieved by application of oscillatory voltages to apertured electrodes 44 of ion transport device 40. As is further discussed in U.S. Pat. No. 7,781,728, transport of ions along ion channel 41 to the device exit may be facilitated by generating a longitudinal DC field and/or by tailoring the flow of the background gas in which the ions are entrained. Ions leave the ion transport device 40 as a narrowly focused beam and are directed through aperture 22 of extraction lens 29 into the second intermediate pressure chamber 25.

Subsequently, the ions pass thereafter through ion optical elements 20, 31 and 24 and are delivered through aperture 27 to a mass analyzer 28 located within chamber 26. The ion optical assemblies or lenses 20, 24 may comprise transfer elements, such as, for instance a multipole ion guide. The mass analyzer 28 comprises one or more detectors 30 whose output can be displayed as a mass spectrum. As depicted in FIG. 1, the mass analyzer may take the form of a conventional two-dimensional quadruple trap having detectors 30. The mass analyzer 28 could alternatively comprise, a time of flight (TOE) mass analyzer, a Fourier transform mass analyzer, an ion trap, a magnetic sector mass analyzer or a hybrid mass analyzer. Chambers 25 and 26 may be evacuated to relatively low pressures by means of connection to ports of a turbo pump, as indicated by the arrows adjacent to vacuum port 17 and vacuum port 19. While ion transport device 40 is depicted as occupying a single chamber, alternative implementations may utilize an ion transport device that bridges two or more chambers or regions of successively reduced pressures.

The reader is referred to U.S. Pat. No. 7,781,728 for more details of the ion transport device 40. Briefly, the ion transport device 40 is formed from a plurality of generally planar electrodes 44 arranged in longitudinally spaced-apart relation (as used herein, the term "longitudinally" denotes the axis defined by the overall movement of ions along ion channel 41). Devices of this general construction are sometimes referred to in the mass spectrometry art as "stacked-ring" ion guides. Each electrode 44 is adapted with an aperture through which ions may pass. The apertures collectively define an ion channel 41, which may be straight or curved, depending on the lateral alignment of the apertures. To improve manufacturability and reduce cost, all of the electrodes 44 may have identically sized apertures. An oscillatory (e.g., radio-frequency) voltage source applies oscillatory voltages to electrodes 44 to thereby generate a field that radially confines ions within ion channel 41. In order to create a tapered field that focuses ions to a narrow beam near the exit of the ion transport device 40, the inter-electrode spacing or the oscillatory voltage amplitude is increased in the direction of ion travel.

The electrodes 44 of the ion transport device 40 may be divided into a plurality of first electrodes interleaved with a plurality of second electrodes, with the first electrodes receiving an oscillatory voltage that is opposite in phase with respect to the oscillatory voltage applied to the second electrodes. Further, a longitudinal DC field may be created within the ion channel 41 by providing a DC voltage source (not illustrated) that applies a set of DC voltages to electrodes 44 in order to assist in propelling ions through the ion transport device 40.

Ion funnel and stacked ring ion guide apparatuses all perform their intended functions adequately. Nonetheless, the use of these prior apparatuses does present some difficulties. First, it is difficult to completely block the "line-of-sight" through such apparatuses for the purpose of preventing neutral molecules from traveling to down-stream mass spectrometer components (including the detector) where they may cause undesirable contamination and spurious detector noise. Secondly, since such apparatuses comprise multiple electrodes, proper alignment of all the components is time consuming and subject to later disruption. Thirdly, for the same reason, such apparatuses are difficult to clean once they do become contaminated. Fourthly, the provision of many parallel electrode plates in these conventional apparatuses produces a naturally high capacitance which may draw high RF power.

Radio Frequency (RF) ion carpets are an alternative type of focusing ion guide. Such RF ion carpets have previously been used in high energy physics experiments, but have not been seen for analytical applications. For example, Takamine et al. ("Space-charge effects in the catcher gas cell of a RF ion guide," Review of Scientific Instruments, 76[10], pp. 103503-103503-6, 2005) and Schwarz ("RF ion carpets: The electric field, the effective potential, operational parameters and an analysis of stability," International Journal of Mass Spectrometry, 299[2-3], pp. 71-77, 2011) have described the use of ion carpets for the capture of high energy particles in high energy physics experiments. The ion carpet apparatus described by Takamine et al. consists of distinct inner and outer regions. The inner region includes 160 concentric ring electrodes to which both RF voltages and DC potentials are applied, the inner-region ring electrodes being included within a diameter of 110 mm and having equal widths of approximately 0.14 mm with 0.14 mm separations between electrodes. The outer region, occupying radii between 55-140 mm, consists of 85 additional equal-width concentric ring electrodes separated by 0.2 mm to which only DC potentials and no RF fields are applied, each such outer-region ring electrode being approximately 0.8 mm wide. Such ion carpet devices should be suitable for use in atmospheric pressure ionization sources used in mass spectrometers and ion mobility spectrometers, but, to date, have not been employed for these analytical applications.

The previously described RF ion carpets have been designed with equally sized and spaced electrodes. Such a design produces a restoring force near the surface of the RF ion carpet that is essentially constant. Such a design presents some problems for mass spectrometry and ion mobility spectrometry applications in that, for spectrometry applications, one would normally like a strong restoring force to initially capture and control the ions, and then a weak restoring force near the center, so that ions can be more easily extracted for transfer to optics further down stream in the instrument. Accordingly, there is a need in the art of analytical ion spectrometry—including mass spectrometry and ion mobility spectrometry—for anew type of ion guide apparatus that it is relatively simple to construct, is easy to clean, can easily provide a complete blockage of line of site, thereby reducing noise at the detector and eliminating contamination concerns, provides a large acceptance aperture than can easily collect ions from multiple sources and that has a lower capacitance and RF usage than an ion funnel or SRIG with an equivalent number of plates. The present invention addresses such a need.

SUMMARY

The inventors have realized that the variable restoring force required to use an RF ion carpet in analytical applications may be achieved by varying the size and spacing of the electrodes on the surface of the ion carpet. A preferred design may use larger electrodes towards the outer edges, to provide a strong repulsive force and initial capture of ions emerging from the atmospheric pressure expansion. Towards the center of the device, smaller electrodes may be used to allow the ions to approach closer to the surface, which would ease the eventual extraction. This variable electrode size and spacing also provides a natural way to increase the DC drag force towards the center while still using a linear voltage divider chain. Accordingly, an ion carpet with progressively sized and spaced electrodes is described which provides a natural way to reduce the repulsive threes near the exit orifice.

In accordance with one aspect of the invention, an ion transport apparatus for a mass spectrometer or an ion mobility spectrometer comprises: (a) a plurality of strip electrodes disposed in a series on a flat substrate; (b) an ion outlet aperture in the substrate disposed adjacent to a first one of the plurality of strip electrodes; (c) a cage electrode at least partially enclosing the plurality of strip electrodes and the ion outlet aperture; (d) extraction electrode disposed adjacent to the ion outlet aperture; (e) a radio frequency (RF) voltage generator operable to supply an oscillatory RF voltage to each of the plurality of strip electrodes such that an RF phase difference exists between each pair of adjacent electrodes; and (f) at least one DC voltage source operable to supply a first DC voltage to the cage electrode, a second DC voltage to the extraction electrode and a respective DC bias voltage to each of the plurality of electrodes, wherein each strip electrode comprises a respective width such that the electrode strip widths of a series of the plurality of electrodes progressively increase away from the first one of the plurality of electrodes.

In accordance with another aspect of the invention, a multiple ion source system for a mass spectrometer or an ion mobility spectrometer comprising: (a) an ion transport apparatus comprising: (i) a plurality of concentrically disposed strip electrodes on a flat substrate, each strip electrode comprising a respective width such that the electrode strip widths of a series of the plurality of strip electrodes progressively increase away from an innermost one of the plurality of electrodes; (ii) an ion outlet aperture in the substrate disposed adjacent to an innermost one of the plurality of strip electrodes; (iii) a cage electrode at least partially enclosing the plurality of strip electrodes and the ion outlet aperture; (iv) an ion transfer tube comprising an extraction electrode disposed adjacent to the ion outlet aperture; (v) a radio frequency (RF) voltage generator operable to supply an oscillatory RF voltage to each of the plurality of strip electrodes such that an RF phase difference exists between each pair of adjacent electrodes; and (vi) at least one DC voltage source operable to supply a first DC voltage to the cage electrode, a second DC voltage to the extraction electrode and a respective DC bias voltage to each of the plurality of electrodes; and (b) a plurality of ion sources circumferentially disposed about the plurality of concentrically disposed strip electrodes such that, in operation of each respective ion source, ions are emitted in the direction of at least a portion of the plurality of strip electrodes.

BRIEF DESCRIPTION OF THE DRAWINGS

The above noted and various other aspects of the present invention will become apparent from the following description which is given by way of non-limiting example only and with reference to the accompanying drawings, not drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended FIGS. 1-5, taken in conjunction with the following description.

Figure 1:
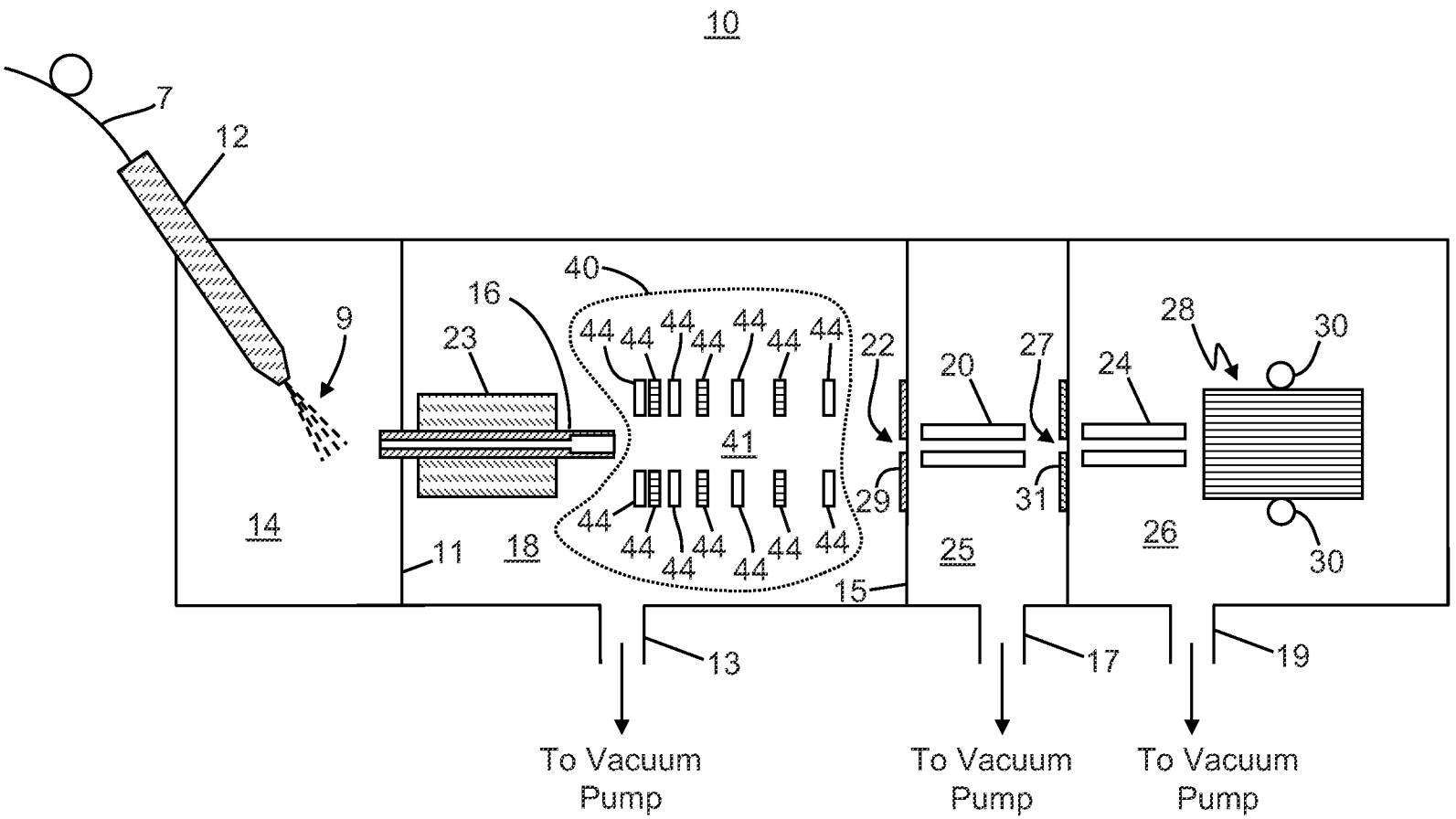
FIG. 1 (Prior Art)
FIG. 1 is a schematic illustration of a known mass spectrometer system.
Figure 2:
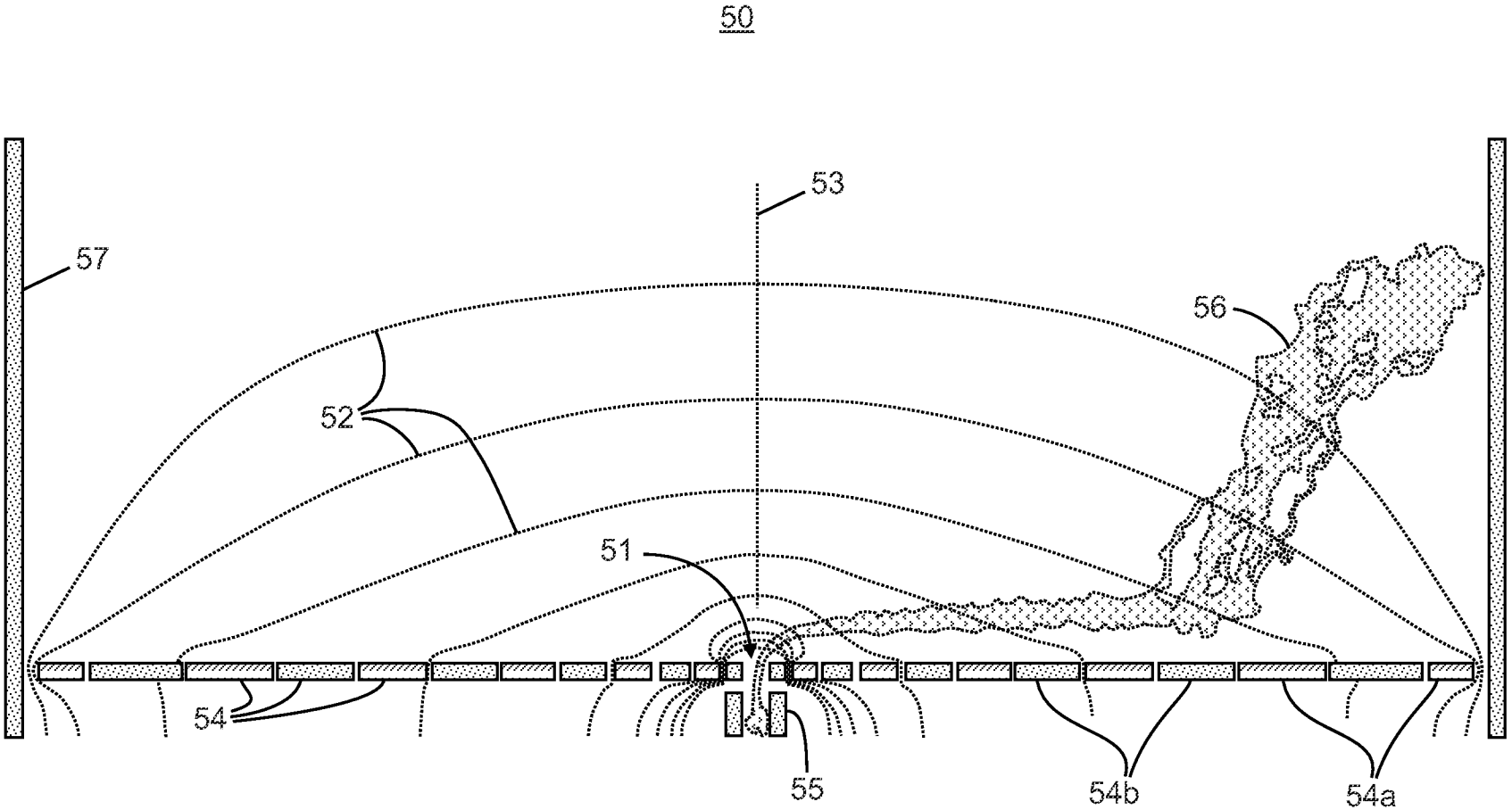
FIG. 2 is a schematic cross-sectional depiction of electrodes of an ion carpet apparatus in accordance with the present teachings, showing calculated electrical equipotential contours and ion trajectories.
Figure 6:
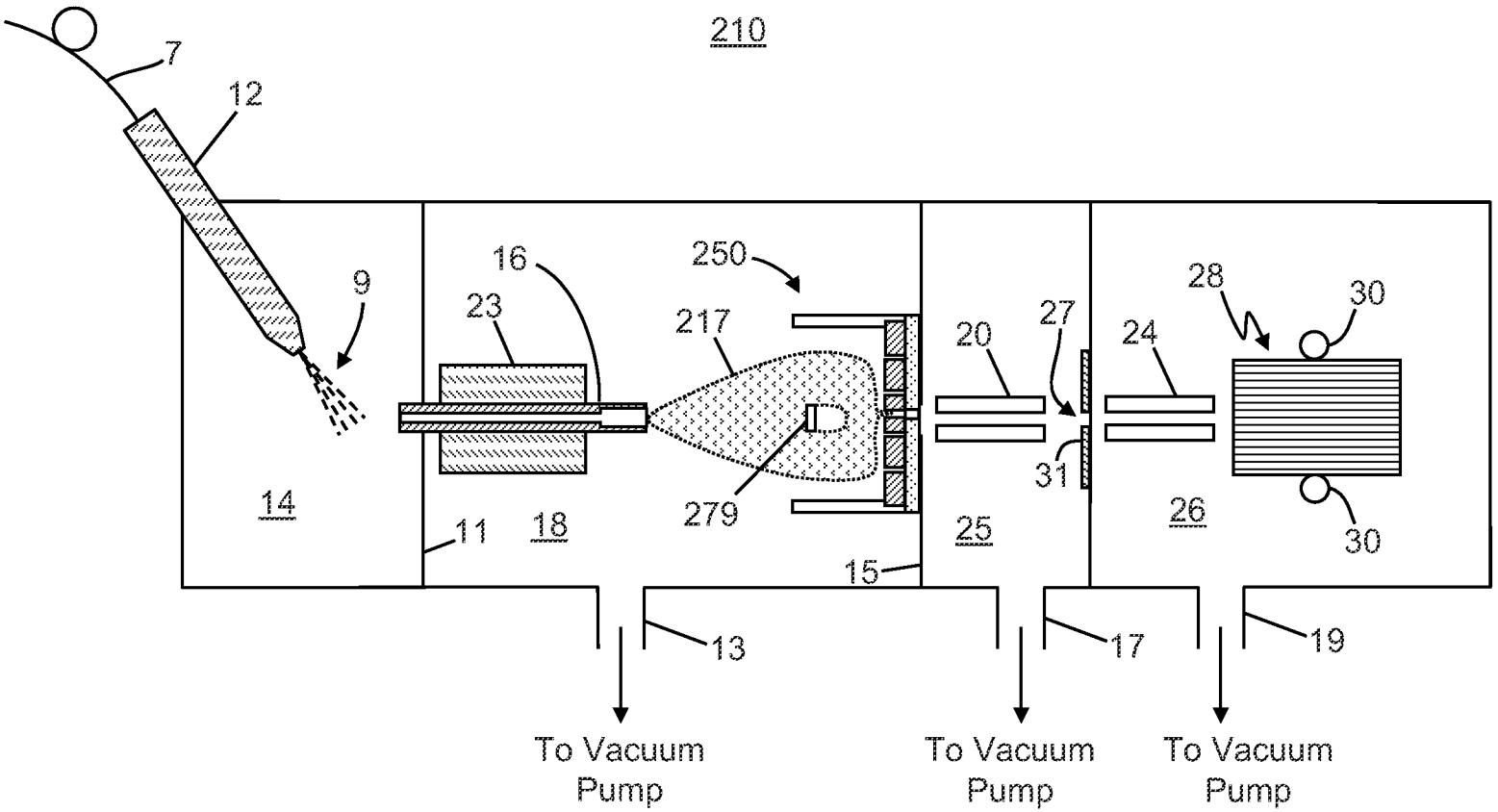
FIG. 6 is a schematic illustration of a mass spectrometer system using an ion carpet apparatus in accordance with the present teachings.

FIG. 2 is a schematic cross-sectional depiction of electrodes of an ion carpet apparatus 50 in accordance with the present teachings. The apparatus 50 comprises a plurality of strip electrodes 54, the width and spacing of which varies from the periphery to the center of the apparatus. As illustrated, the apparatus is symmetrical about a central axis or plane 53. Generally, wider electrodes are located towards the outer edges—away from the central axis or plane 53 and the electrode width becomes progressively narrower towards the center. A cage electrode 57 partially surrounds the plurality of strip electrodes 54 and an outlet aperture 51 is disposed inward from the innermost electrode or electrodes, preferably along the central axis or plane 53. An extraction electrode 55 is disposed adjacent to the innermost strip electrode and supplied with a voltage so as to receive ions exiting the apparatus 50 through the outlet aperture 51. The extraction electrode 55 may comprise, for example, an ion transfer tube or any other form of ion transfer optics or ion optical assembly that serves to transfer ions collected by and from the ion carpet to another portion of an ion spectrometer (e.g., a mass spectrometer or an ion mobility spectrometer) of which the ion carpet apparatus is a part. The extraction electrode may comprise a dedicated component of the ion carpet apparatus. Alternatively, the extraction electrode may comprise ion transfer optics that would normally be present in a mass spectrometer apparatus, even in the absence of the ion carpet such as, for example, ion optical assembly or lens 20 which may be used in the prior art apparatus (FIG. 1) or in conjunction with the ion carpet apparatus (FIG. 6). In other words, the optical assembly or lens 20 may serve as the extraction electrode or as a portion of the extraction electrode.

In operation of the RF ion carpet apparatus 50, an RF voltage generator (not shown in FIG. 2) is electrically coupled to and provides an oscillatory voltage to each of the plurality of strip electrodes 54 such that an RF phase difference $\Delta\phi$ exists between each pair of electrodes. For instance, FIG. 2 illustrates a preferred configuration in which the plurality of strip electrodes 54 consists of two electrode subsets—a first electrode subset 54*a* and a second electrode subset 54*b* indicated by different shading patterns—such that an RF phase difference of $\pi$ (180 degrees) occurs between each pair of adjacent electrodes. Further, at least one Direct Current (DC) voltage generator supplies a respective DC bias voltage to each one of the plurality of strip electrodes 54. A DC voltage is also supplied to the cage electrode 57.

FIG. 2 further shows iso-potential lines 52 calculated using a one-dimensional electrostatic model in which the width of the ion carpet apparatus is set to 100 mm, the width of the outlet aperture is set to 2 mm, the voltage in the cage electrode is set to 10 V, the voltage on the extraction electrode 55 is set to −110 V and the difference in bias DC potential between each adjacent pair of electrodes is set at 1 V. The model also employs a 750 kHz RF voltage having a peak amplitude 200V applied to each strip electrode. Ions ranging in mass-to-charge ratio (m/z) from 100 to 1000 are assumed to be generated from an ion source (not shown) located at a point near the top right corner of the apparatus. Ion trajectories through the ion carpet apparatus 50 were simulated using SIMION® charged-particle optics simulation software commercially available from Scientific Instrument Services of 1027 Old York Rd. Ringoes N. J. 08551-1054 USA. The simulation was run in conjunction with a collision model in order to account for interactions between ions and gas molecules at a static gas pressure of 2 Torr.

The overall locus of ion pathways within the apparatus 50, as calculated according to the SIMION® simulation, as described above, is indicated by ion cloud 56. The simulations show high efficiency transfer of ions from the edge of the device to the central outlet aperture 51. An order of magnitude in mass is easily transferred without any variation in conditions. As can be seen in FIG. 2, the ions move closer and closer to the carpet as they approach the exit outlet aperture, as a result in the gradient in electrostatic potential—as indicated by iso-potential lines 52—generated by the DC bias-voltage difference between the cage electrode and the strip electrodes. As the ions approach the electrodes, the applied out-of-phase RF voltages maintain the cloud within a confined volume region slightly separated from the surfaces of the strip electrodes. The simulation indicates that the high mass ions travel slightly closer to the surface due to the weaker restoring force that is experienced, but at a distance that should avoid any issues with collisions. This behavior results in optimal positioning for extraction through the outlet aperture 51 to the extraction electrode or ion transfer optics 55.

Figure 3A:
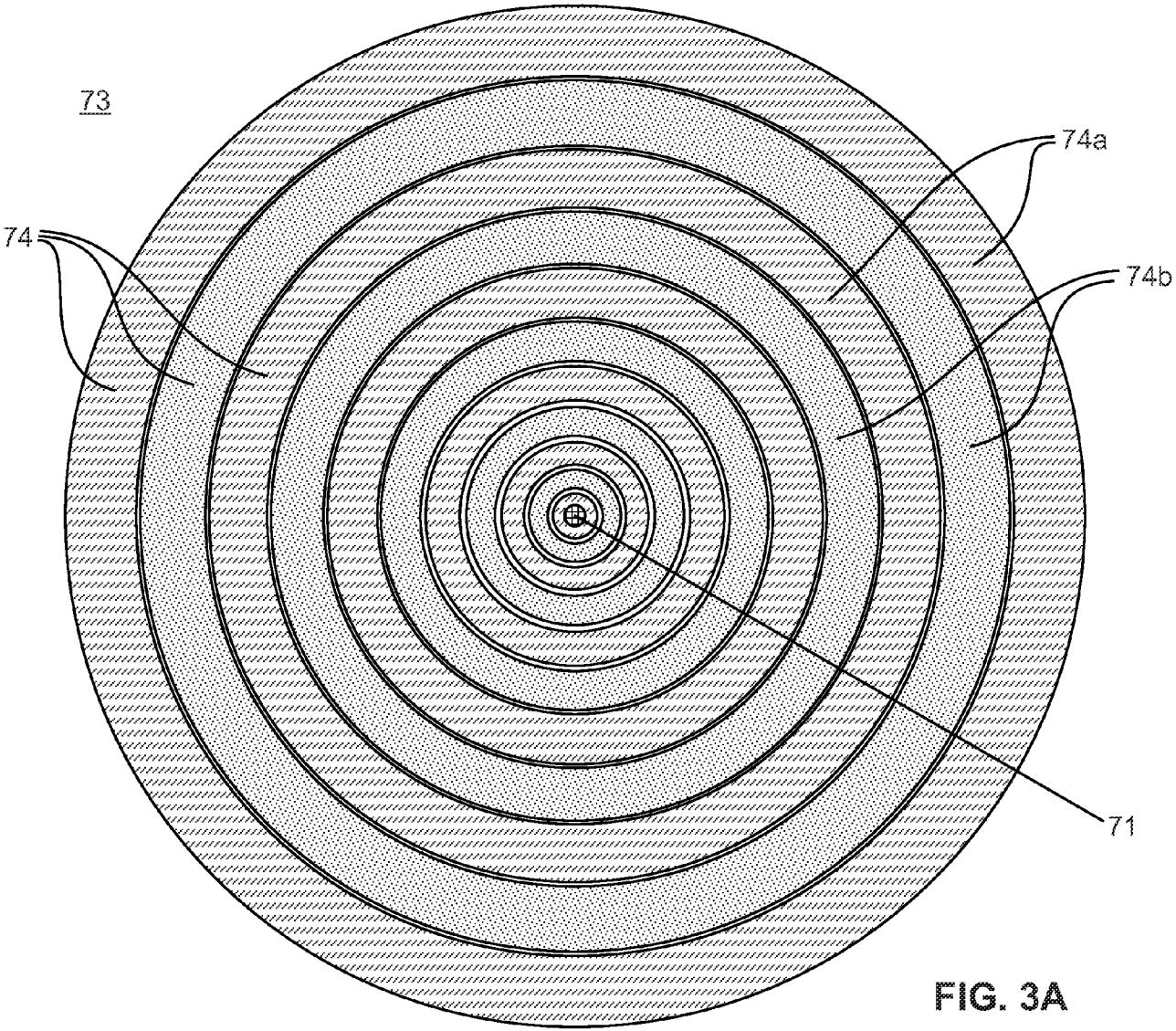
FIG. 3A is a top view of an electrode structure of an ion carpet apparatus in accordance with the present teachings.
Figure 3B:
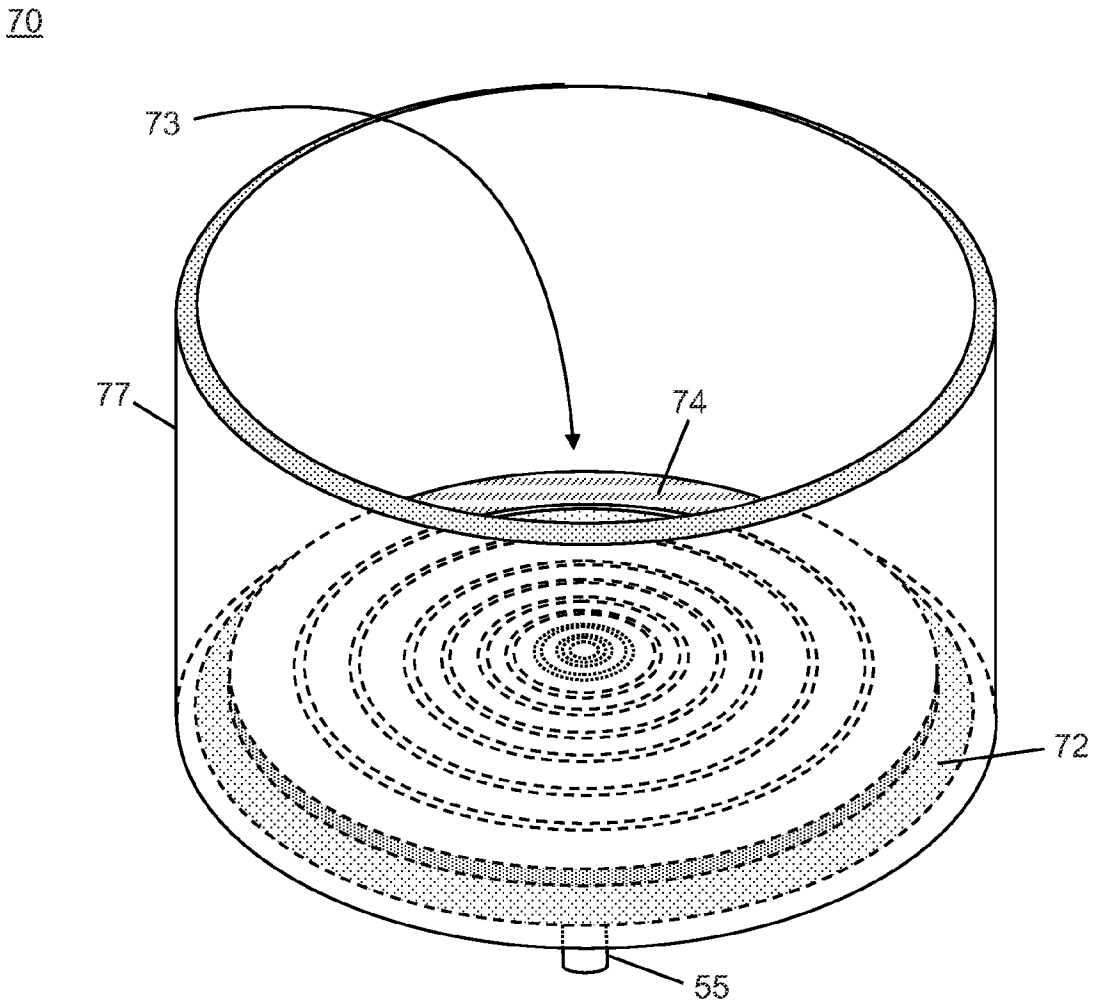
FIG. 3B is a perspective view of an ion carpet apparatus that utilizes the electrode structure of FIG. 3A.

The one-dimensional ion trajectory simulation whose results are indicated in FIG. 2 does not provide ion confinement in a direction outside of the plane of the diagram. As a practical matter, however, ion confinement may be achieved by fabricating the electrode strips as annular rings or annular arcs. The annular ring electrodes 74 illustrated in the ion electrode set 73 of FIG. 3A are an example of how such ring electrodes may be configured, in similar fashion to the strip electrodes 54 shown in FIG. 2, the width of the annular ring electrodes 74—as measured radially across the apparatus—progressively decreases inwardly through the apparatus. Also similarly to the configuration illustrated in FIG. 2, the annular ring electrodes 74 consist of two electrode subsets—a first electrode subset 74*a* and a second electrode subset 74*b* indicated by different shading patterns—such that an RF phase difference of π (180 degrees) occurs between each pair of adjacent electrodes. Because of the geometry of the electrode configuration shown in FIG. 3, taken in conjunction with the application of appropriate DC drag field gradients and the out-of-phase RF voltages across adjacent electrodes, ions will be subject to time-averaged three vectors which are directed radially inward and downward towards an outlet aperture 71 disposed centrally within the electrode set 73.

The cage electrode 77 (FIG. 3B) of the ion carpet apparatus 70 may comprise a hollow cylinder at least partially enclosing the electrode set 73 comprising the annular ring electrodes 74. The annular ring electrodes 74 may be formed from any suitable conductive material but, advantageously, may be fabricated as thin metal straps attached to a substrate 72. The substrate 72 may advantageously be provided as a printed circuit board which provides all the appropriate electrical connections required to provide DC and RF voltages to the annular ring electrodes 74. With the application of appropriate DC bias voltages to the annular ring electrodes 74 and the cage electrode 72, an appropriate extraction voltage to the extraction electrode or ion transfer optics 55 and appropriate out-of-phase RF voltages across adjacent electrodes 74, ions will be caused to migrate radially inward and downward above the surface of the surface of the electrode set 73 so as to be collected by the outlet aperture 71 and directed into the extraction electrode or ion transfer optics 55. The substrate may include a heater so as to heat the electrode set to prevent condensation of materials introduced from ion sources.

Figure 4:
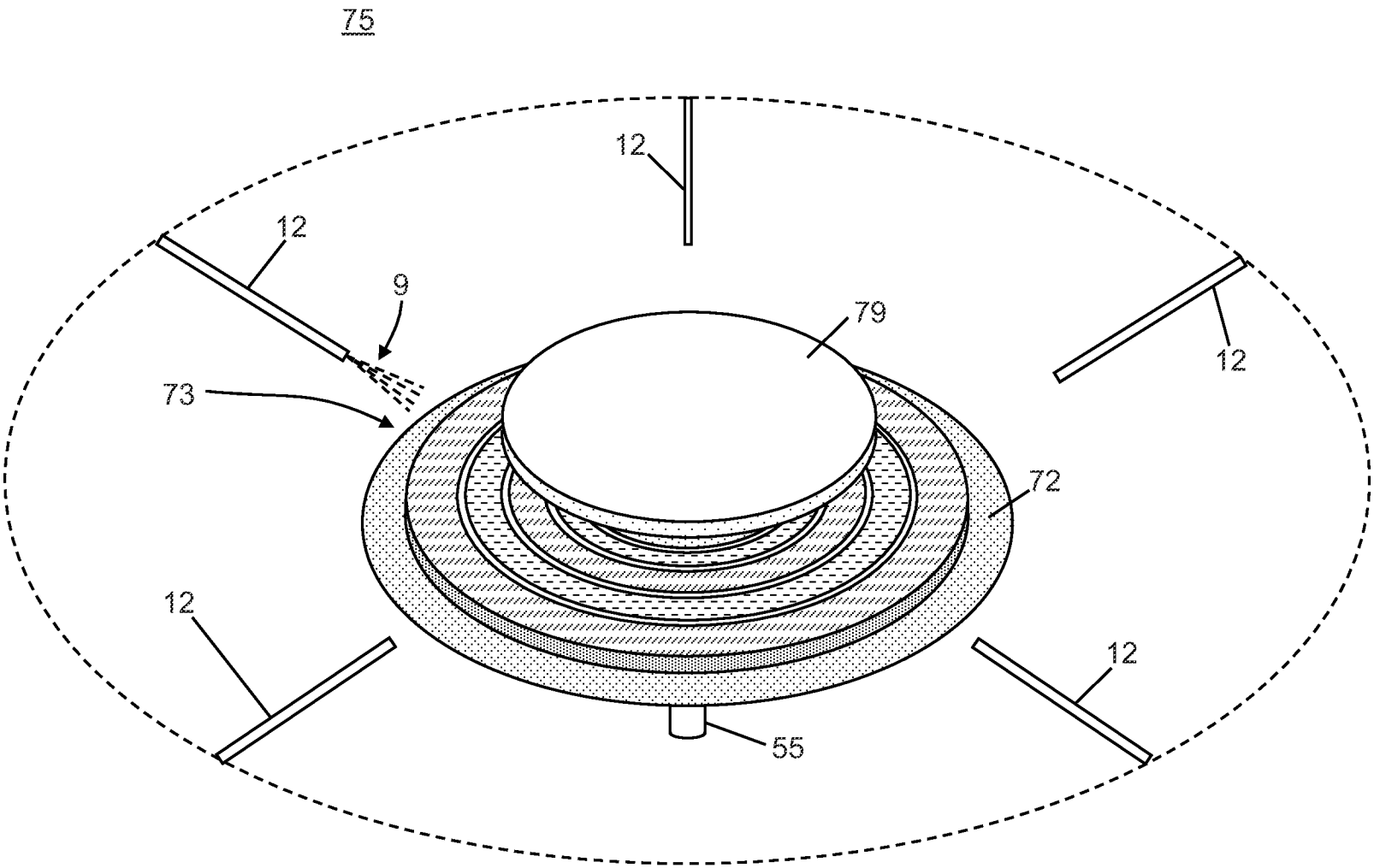
FIG. 4 is a perspective view of an ion carpet apparatus used as an ion collection lens from multiple atmospheric pressure ion sources.

FIG. 4 illustrates one example of usage of an ion carpet apparatus in accordance with the present teachings. In FIG. 4, the ion carpet apparatus is shown utilized at atmospheric pressure as an ion collection lens from multiple atmospheric pressure ion sources 12. Accordingly, the ion carpet apparatus may be used within an ionization chamber 14 as shown in FIG. 1. Each atmospheric pressure ion source 12 is capable of producing a plume of charged particles 9, including ions, generally directed inward into the cage electrode (not shown) towards the electrode plate 73 of the ion carpet apparatus. Often times, the ion plume 9 will include charged solvent droplets in addition to free ions. Therefore, a shield 79 may be deployed so as to block any direct line of sight between any of the ion sources 12 and the outlet aperture (at the center of the electrode set 73) so as to prevent any droplets from entering the outlet aperture. Although the shield 79 is illustrated as a plate disposed above the electrode set 73 in FIG. 4, the shield may be formed in any suitable shape and configuration, such as a cylindrical part disposed within the inner diameter of the cage electrode (not shown). The relative configuration of the ion sources 12, the cage electrode and the shield 79 should allow the ions to be able to migrate downwards towards the electrode set and to hover above the electrodes (under the application of appropriate DC and RF fields) as described previously in reference to FIG. 2.

The configuration shown in FIG. 4 may permit "multiplexing" of analyses of several samples—each sample introduced to a different one of the ion sources—using a single ion spectrometer. Because of the radial symmetry of the apparatus, ions derived from the multiple ion sources 12 may be captured and directed into the extraction electrode or ion optics 55 with the same efficiency. The various ion sources 12 need not produce ions by the same process; for example some of the ion sources may be electrospray ion sources whereas others of the sources comprise atmospheric pressure chemical ionization sources.

Figure 5:
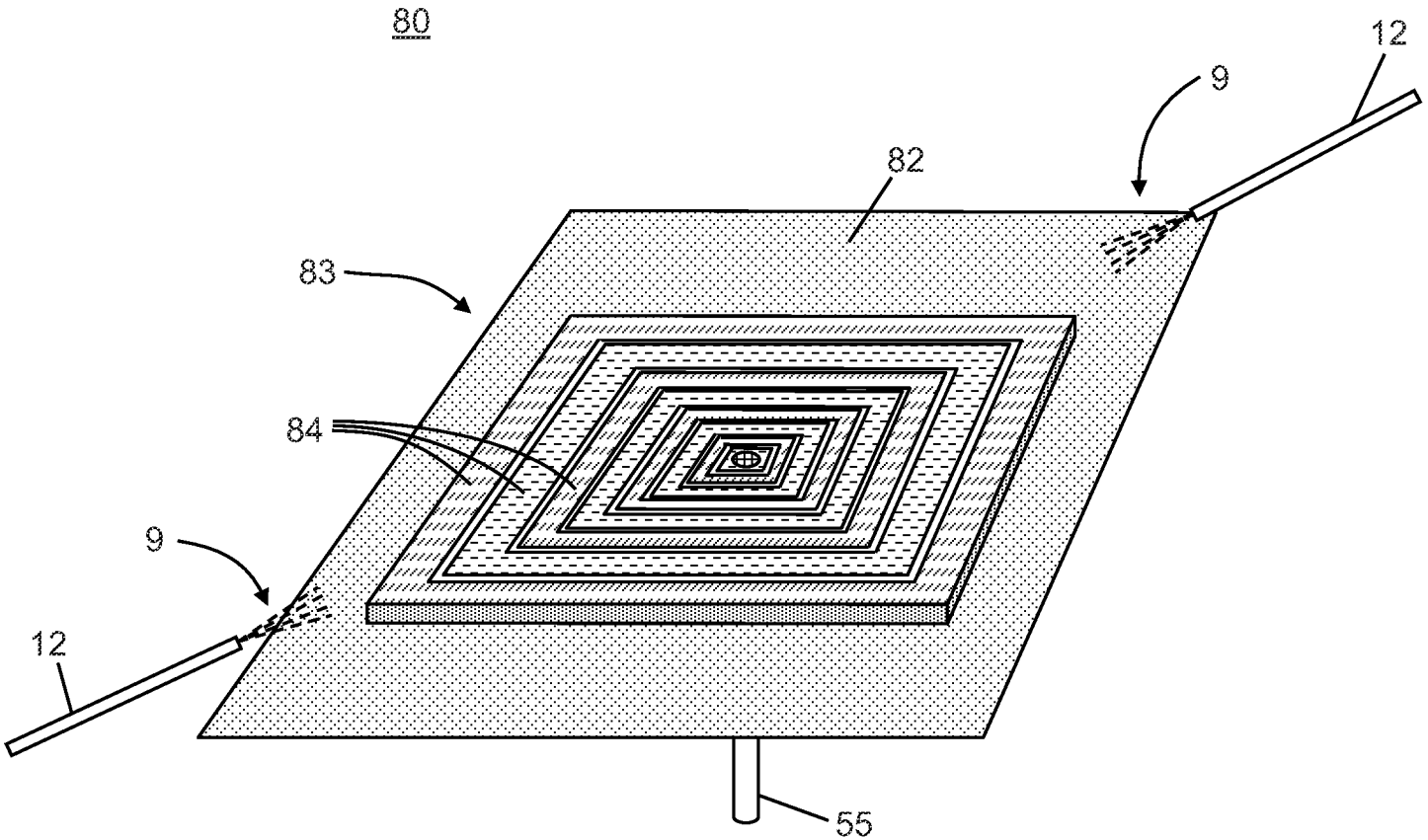
FIG. 5 is a perspective view of another ion carpet apparatus in accordance with the present teachings.

FIG. 5 illustrates an alternative ion carpet apparatus 80 in accordance with the present teachings and provides a second example of how ring electrodes of the apparatus may be configured. In the configuration shown, the ion carpet apparatus may be used within an ionization chamber 14 as shown in FIG. 1 so as to collect ions emitted by one or more on sources 12. In the ion carpet apparatus 80 (FIG. 5) the electrode set 83 comprises a set of concentric rectangular rings 84 disposed on a substrate 82 which may also be rectangular so as to match the shape of the rectangular rings 84. A cage electrode (not shown) may be formed as a hollow 4-sided rectangular "box" partially surrounding the electrodes 84. Because of the straight sides of the electrodes 84, it may be advantageous to dispose ion sources 12 so as direct the charged-particle plumes 9 towards the electrode corners so as to confine ions within a narrow region. A shield (not shown) of any suitable form may be employed to prevent ingestion of charged droplets into the outlet aperture and extraction electrode or ion optics 55, as previously described with reference to FIG. 4. Other aspects of the apparatus 80 are similar to the descriptions already provided.

FIG. 6 illustrates another example of usage of an ion carpet apparatus in accordance with the present teachings. The mass spectrometer system 210 illustrated in FIG. 5 is similar to the known mass spectrometer system 10 shown in FIG. 1 except that the ion transport device 40 of the known system is replaced by the ion carpet apparatus 250. In FIG. 6, the ion carpet apparatus 250 is shown utilized as an ion collection and focusing apparatus for collecting a plume 217 of ions that emerges from an ion transfer tube 16 into an intermediate vacuum chamber 18 of a mass spectrometer system 210. Generally, there is a differential pressure of 750 to 760 Torr across the length of the ion transfer tube (e.g., ion transfer tube 16 of FIGS. 1 and 6) which leads to a rapid expansion at the outlet end. This expansion is characterized by a rapid increase of the velocity of the ionized analyte containing gas that flows into the first vacuum stage 18 of the mass spectrometer. Thus, a device with a high aspect ratio (ratio to width to height), such as an ion carpet apparatus in accordance with the present teachings, is useful for collecting and focusing the ions emerging from the ion transfer tube 16.

The ion carpet apparatus 250, which may comprise, for example, the apparatus 70 shown in FIG. 3, serves to transfer the collected and focused ions into the second intermediate-pressure chamber 25 or, in the absence of a second intermediate-pressure chamber, into the high-vacuum chamber 26. The shape of the electrode set of the ion carpet apparatus could be circular as shown in FIG. 3 or could comprise some other shape, possibly chosen so as to match a cross sectional shape of the ion plume 217 that emerges from the ion transfer tube 16. For example, the electrode set and the electrodes therein could be rectangular in shape as illustrated in FIG. 5 or could be comprise an oval shape or some other shape. As shown, the ion carpet apparatus includes a shield 279 to block direct flow of neutral gas molecules or any residual droplets into the second intermediate-pressure or high-vacuum chamber. In other embodiments, the center of the ion carpet apparatus 250 could be positioned so as to be non-coaxial with the ion transfer tube, thereby eliminating a direct line of sight between the ion transfer tube and the outlet aperture of the ion carpet apparatus.

The ion carpet apparatuses as described herein are expected to have several benefits over current high pressure RF devices like the SRIG and ion funnel. First, it is very simple to provide a complete blockage of line of site, thus reducing noise at the detector and eliminating concern about contamination of the instrument further down stream. Second, since the design is typically flat, apparatuses in accordance with the present teachings are relatively simple to construct. Third, the larger acceptance aperture of apparatuses in accordance with the present teachings can easily collect ions from multiple sources. Fourth, these apparatuses are very easy to clean. Fifth, the capacitance should be lower than a SRIG with an equivalent number of plates, and therefore should these novel apparatuses should use less RF power.

Improved ion collection, focusing, and transfer devices for on spectrometers used in analytical applications have been described. The novel devices are based on the concept of an ion carpet having concentric electrodes comprising electrode widths which progressively decrease from edge to center. The discussion included in this application is intended to serve as a basic description. Although the present invention has been described in accordance with the various embodiments shown and described, one of ordinary skill in the art will readily recognize that there could be variations to the embodiments or combinations of features in the various illustrated embodiments and those variations or combinations of features would be within the spirit and scope of the present invention. The reader should thus be aware that the specific discussion may not explicitly describe all embodiments possible; many alternatives are implicit. Accordingly, many modifications may be made by one of ordinary skill in the art without departing from the scope and essence of the invention. Neither the description nor the terminology is intended to limit the scope of the invention—the invention is defined only by the claims. Any patents, patent applications or other publications mentioned herein are hereby explicitly incorporated herein by reference in their respective entirety.

What is claimed is:

1. An ion transport apparatus for a mass spectrometer or an ion mobility spectrometer comprising:

(a) a plurality of strip electrodes disposed in a series on a flat substrate;

(b) an ion outlet aperture in the substrate disposed adjacent to a first one of the plurality of strip electrodes;

(c) a cage electrode at least pa ally enclosing the plurality of strip electrodes and the ion outlet aperture;

(d) an extraction electrode disposed adjacent to the ion outlet aperture;

(e) a radio frequency (RF) voltage generator operable to supply an oscillatory RF voltage to each of the plurality of strip electrodes such that an RF phase difference exists between each pair of adjacent electrodes; and (f) at least one DC voltage source operable to supply a first DC voltage to the cage electrode, a second DC voltage to the extraction electrode and a respective DC bias voltage to each of the plurality of electrodes, wherein each strip electrode comprises a respective width such that the electrode strip widths of a series of the plurality of electrodes progressively increase away from the first one of the plurality of electrodes.

2. An ion transport apparatus as recited in claim 1, wherein the plurality of strip electrodes comprise a plurality of concentric electrodes such that the first one of the plurality of electrodes is the innermost one of the plurality of concentric electrodes.

3. An ion transport apparatus as recited in claim 2, wherein the plurality of concentric electrodes comprise a plurality of circular rings.

4. An ion transport apparatus as recited in claim 3, wherein the cage electrode comprises a hollow circular cylinder.

5. An ion transport apparatus as recited in claim 3, wherein the cage electrode comprises a hollow rectangular cylinder.

6. An ion transport apparatus as recited in claim 2, wherein the plurality of concentric electrodes comprises a plurality of rectangular rings.

7. An ion transport apparatus as recited in claim 1, wherein the flat substrate comprises a printed circuit board comprising electrical connections providing the oscillatory RF voltage and the DC bias voltages to the plurality of strip electrodes.

8. An apparatus as recited in claim 1, wherein the extractor electrode comprises an ion transfer tube.

9. A multiple ion source system for a mass spectrometer or an ion mobility spectrometer comprising:

(a) an ion transport apparatus comprising:

(i) a plurality of concentrically disposed strip electrodes on a flat substrate, each strip electrode comprising a respective width such that the electrode strip widths of a series of the plurality of strip electrodes progressively increase away from an innermost one of the plurality of electrodes;

(ii) an ion outlet aperture in the substrate disposed adjacent to an innermost one of the plurality of strip electrodes;

(iii) a cage electrode at least partially enclosing the plurality of strip electrodes and the ion outlet aperture;

(iv) an ion transfer tube comprising an extraction electrode disposed adjacent to the ion outlet aperture;

(v) a radio frequency (RE) voltage generator operable to supply an oscillatory RF voltage to each of the plurality of strip electrodes such that an RF phase difference exists between each pair of adjacent electrodes; and (vi) at least one DC voltage source operable to supply a first DC voltage to the cage electrode, a second DC voltage to the extraction electrode and a respective DC bias voltage to each of the plurality of electrodes; and (b) a plurality of ion sources circumferentially disposed about the plurality of concentrically disposed strip electrodes such that, in operation of each respective ion source, ions are emitted in the direction of at least a portion of the plurality of strip electrodes.

10. A multiple ion source system as recited in claim 9, wherein the plurality of concentric electrodes comprises a plurality of circular rings.

11. A multiple ion source system as recited in claim 9, wherein the plurality of concentric electrodes comprises a plurality of rectangular rings.

12. A multiple ion source system as recited in claim 11, wherein the plurality of ion sources are disposed such that, in operation of each respective ion source, ions are emitted in the direction of a corner section of the plurality of strip electrodes.

13. A multiple ion source system as recited in claim 12, further comprising at least one shield disposed so as to block a direct line of between the plurality of ion sources and the ion outlet aperture.

14. A multiple ion source system as recited in claim 9, wherein the flat substrate comprises a printed circuit board comprising electrical connections providing the oscillatory RF voltage and the DC bias voltages to the plurality of concentrically disposed strip electrodes.

15. An improved mass spectrometer system comprising an atmospheric pressure ionization chamber receiving ions from an atmospheric pressure ionization source, an intermediate-pressure chamber, an ion transfer tube operable to transfer the ions from the atmospheric pressure ionization chamber to the intermediate pressure chamber and a high-vacuum chamber operable to receive the ions from the intermediate-pressure chamber and having a mass analyzer therein, the improvement comprising:

(a) a plurality of strip electrodes, each strip electrode having a respective width, disposed in a series on a flat substrate within the intermediate-pressure chamber such that ions exiting the ion transfer tube are directed towards a portion of the plurality of strip electrodes, wherein the widths of a series of the plurality of electrodes progressively increase away from a first one of the plurality of electrodes;

(b) an ion outlet aperture in the substrate disposed adjacent to the first one of the plurality of strip electrodes, the outlet aperture operable to transfer the ions out of the intermediate-pressure chamber towards the high-vacuum chamber;

(c) a cage electrode within the intermediate-pressure chamber at least partially enclosing the plurality of strip electrodes and the ion outlet aperture;

(d) an extraction electrode disposed adjacent to the ion outlet aperture;

(e) a radio frequency (RF) voltage generator operable to supply an oscillatory RF voltage to each of the plurality of strip electrodes such that an RF phase difference exists between each pair of adjacent electrodes; and (f) at least one DC voltage source operable to supply a first DC voltage to the cage electrode, a second DC voltage to the extraction electrode and a respective DC bias voltage to each of the plurality of electrodes.

16. An improved mass spectrometer system as recited in claim 15, further comprising at least one shield disposed so as to block a direct line of between the ion transfer tube and the ion outlet aperture.

17. An improved mass spectrometer system as recited in claim 15, wherein the plurality of strip electrodes comprises a plurality of concentric electrodes such that the first one of the plurality of electrodes is the innermost one of the plurality of concentric electrodes.

18. An improved mass spectrometer system as recited in claim 15, wherein the flat substrate comprises a printed circuit board comprising electrical connections providing the oscillatory RF voltage and the DC bias voltages to the plurality of strip electrodes.

* * * * *